US011146874B2

(12) United States Patent
Bottoni et al.

(10) Patent No.: US 11,146,874 B2
(45) Date of Patent: Oct. 12, 2021

(54) LOUDSPEAKER ASSEMBLY AND HEADPHONES FOR SPATIALLY LOCALIZING A SOUND EVENT

(71) Applicant: USound GmbH, Graz (AT)

(72) Inventors: Ferruccio Bottoni, Graz (AT); Andrea Rusconi Clerici Beltrami, Vienna (AT); Thomas Gmeiner, Vienna (AT); Hannes Pomberger, Graz (AT); Alois Sontacchi, Gratwein-Strassengel (AT)

(73) Assignee: USound GmbH, Graz (AT)

( * ) Notice: Subject to any disclaimer, the term of this patent is extended or adjusted under 35 U.S.C. 154(b) by 0 days.

(21) Appl. No.: 16/639,670

(22) PCT Filed: Aug. 14, 2018

(86) PCT No.: PCT/EP2018/072035

§ 371 (c)(1),
(2) Date: Feb. 17, 2020

(87) PCT Pub. No.: WO2019/034656

PCT Pub. Date: Feb. 21, 2019

(65) Prior Publication Data

US 2020/0252710 A1 Aug. 6, 2020

(30) Foreign Application Priority Data

Aug. 17, 2017 (DE) ..... 10 2017 118 815.0

(51) Int. Cl.

| | |
|---|---|
| ***H04R 1/10*** | (2006.01) |
| ***H04R 1/26*** | (2006.01) |
| ***H04R 5/033*** | (2006.01) |

(52) U.S. Cl.

CPC ..... *H04R 1/1008* (2013.01); *H04R 1/26* (2013.01); *H04R 5/0335* (2013.01); *H04R 2201/003* (2013.01); *H04R 2205/022* (2013.01)

(58) Field of Classification Search

CPC .... H04R 1/10; H04R 2205/022; H04R 1/105; H04R 5/0335; H04R 2201/10; H04R 2460/13; H04R 1/1016

(Continued)

(56) References Cited

U.S. PATENT DOCUMENTS 6,263,085 B1 * 7/2001 Weffer ..... H04R 1/1075 381/376
6,658,121 B1 12/2003 König (Continued)

FOREIGN PATENT DOCUMENTS

CN 101627640 A 1/2010
CN 205283773 U 6/2016

(Continued)

OTHER PUBLICATIONS

International Search Report, dated Oct. 15, 2018, 3.
Chinese Office Action with Translation, dated Jun. 17, 2021, 17 pages.

*Primary Examiner* — Suhan Ni
(74) *Attorney, Agent, or Firm* — Dority & Manning, P.A.

(57) ABSTRACT

A loudspeaker assembly for on-ear headphones, to be arranged on and/or over the ear, includes a housing in which a woofer is arranged and configured to emit low frequency sound waves along a low frequency sound beam axis toward the wearer's the ear. At least one tweeter is arranged in the housing and configured to emit high frequency sound waves along a high frequency sound beam axis toward the wearer's the ear. The at least one tweeter is a MEMS loudspeaker.

18 Claims, 9 Drawing Sheets

(58) Field of Classification Search
USPC ..... 381/370–384
See application file for complete search history.

(56) References Cited

U.S. PATENT DOCUMENTS

| | | | | |
|---|---|---|---|---|
| 9,918,177 | B2 | 3/2018 | Horbach | |
| 2004/0032964 | A1* | 2/2004 | Liang | H04R 5/0335 381/370 |
| 2004/0040941 | A1 | 3/2004 | Ecklund et al. | |
| 2005/0207606 | A1 | 9/2005 | Yang | |
| 2016/0360321 | A1* | 12/2016 | Margalit | G10K 11/22 |

FOREIGN PATENT DOCUMENTS

| | | |
|---|---|---|
| CN | 106714021 A | 5/2017 |
| EP | 1071309 | 1/2004 |
| EP | 3188513 | 7/2017 |
| GB | 2486688 | 6/2012 |
| JP | 2009141879 | 6/2009 |
| WO | WO 2004/040941 | 5/2004 |
| WO | WO 2015178760 | 11/2015 |

* cited by examiner

LOUDSPEAKER ASSEMBLY AND HEADPHONES FOR SPATIALLY LOCALIZING A SOUND EVENT

FIELD OF THE INVENTION

The present invention relates to a loudspeaker assembly, in particular on-ear headphones, to be arranged on and/or over the ear, comprising a housing in which a woofer is arranged, with the aid of which low frequency sound waves can be emitted along a low frequency sound beam axis toward the ear, and in which at least one tweeter is arranged, with the aid of which high frequency sound waves can be emitted along a high frequency sound beam axis.

BACKGROUND OF THE INVENTION

For modern applications, for example, for so-called virtual reality or augmented reality, it is advantageous when a localization of a sound event in space is made possible for the human ear with the aid of a headphone and the sounds generated therewith. In the case of a 3D object, the associated 3D sounds should also be delivered, in order to allow for a more realistic reproduction of a landscape or, for example, a virtual orchestra.

The human ear can localize natural sounds and/or sound events, such as a chirping of birds, in space, for example, on the basis of a difference of the propagation time of the sound waves to the two ears. Phase differences between the sound waves with respect to the two ears can also play a role in this case. With conventional stereo headphones, the spatial position-finding of the sound event is not always possible. However, specifically in the case of virtual reality and, for example, while observing the 3D object, it should be the case that the 3D tone is also generated, in order to ensure not only a three-dimensional viewing experience, but also a three-dimensional listening experience. For example, a spatial position of the source of the sound event that is always the same should be recognizable during the turning of the head.

EP 1 071 309 B1 describes a headphone comprising two housings, a right and a left housing assigned to the ears of a user, which comprise baffles, in which dynamic sound transducers are arranged, each of which includes a tweeter and a midrange driver/woofer arranged coaxially therewith. A sound event can be localized with the aid of a shadowing of sound waves. The disadvantage thereof is that such sound waves are only poorly suited for generating the 3D tone.

OBJECTS AND SUMMARY OF THE INVENTION

The object of the present invention is therefore to eliminate the disadvantages of the related art.

The object is achieved by means of a loudspeaker assembly and a headphone having the features of the independent patent claims.

The invention relates to a loudspeaker assembly to be arranged on and/or over the ear. The loudspeaker assembly can be utilized, for example, for on-ear headphones. The headphone can comprise, for example, ear cups, in which the loudspeaker assembly is arranged. With the aid of the loudspeaker assembly, preferably a 3D sound can be generated, so that a virtual sound event, which can be played back by the loudspeaker assembly, is localizable in space for the human ear. As a result, the human ear can localize a spatial origin of the virtual sound event. With the aid of the loudspeaker assembly, the human ear can, for example, detect that a virtual source of sound is situated in front of the head of the wearer. As a result, a listening experience can be improved, in particular in connection with a virtual and/or augmented reality.

The loudspeaker assembly comprises a housing. A woofer is arranged in the housing, with the aid of which low frequency sound waves can be emitted along a low frequency sound beam axis toward the ear. Moreover, at least one tweeter is arranged in the housing, with the aid of which high frequency sound waves can be emitted along a high frequency sound beam axis. The low frequency sound waves of the woofer can have a low frequency. Low frequencies can have a frequency range, which is arranged in a lower audible spectrum for the human ear. The low frequency sound waves can comprise, for example, frequencies of 20 Hz, i.e, starting at a low hearing threshold of the human ear, to 1 kHz-2 kHz. These are the frequencies that can be emitted by the woofer or from woofers.

Likewise, the tweeter can emit relatively high frequencies. This comprises, in particular, frequencies, which are situated above the frequencies of the low frequency sound waves. The frequencies of the high frequency sound waves can extend, for example, from 1 kHz-2 kHz to 15 kHz-20 kHz, i.e., approximately up to the upper hearing threshold of the human ear.

For example, the low tones can be played back with the aid of the woofer and the high tones can be played back with the aid of the tweeter.

The low frequency sound beam axis, as well as the high frequency sound beam axis, can be the axes, along which the emitted beam from the woofer or from the tweeter, respectively, has a maximum intensity. The low frequency sound beam axis or the high frequency sound beam axis can be oriented, for example, coaxially with a central axis of the woofer or of the tweeter. The woofer emits the low frequency sound waves essentially along the low frequency sound beam axis. Most of the sound power can be arranged along the low frequency sound beam axis.

According to the invention, the at least one tweeter is a MEMS loudspeaker. MEMS is an abbreviation for microelectromechanical systems. Very clear frequencies can be played back with the aid of the MEMS loudspeaker. In addition, the MEMS loudspeaker can have a low total harmonic distortion. The MEMS loudspeaker can play back sound waves having frequencies that deviate very little from setpoint frequencies. The MEMS loudspeaker likewise has low distortion. As a result, a localization of the virtual sound event can be simplified for the human ear.

Moreover, a broad frequency spectrum can be played back with the aid of the MEMS loudspeaker. The MEMS loudspeaker can simultaneously play back frequencies in the middle-frequency range, for example, from 1 kHz-2 kHz to 8 kHz-10 kHz, and frequencies in the high frequency range. Therefore, a midrange driver and a tweeter can be implemented with the aid of a single MEMS loudspeaker. In addition, sound waves above 20 kHz can be generated with the aid of the MEMS loudspeaker.

In addition, the MEMS loudspeaker can be designed to be very small, so that, with the aid thereof, high frequency sound waves can be generated that reach the human ear from a small solid angle. As a result, the human ear can highly precisely localize the origin of the high frequency sound waves.

In addition to the low frequency sound waves of the woofer, high frequency sound waves, with the aid of which the human ear can localize the origin of the virtual sound event, can be played back with the aid of the tweeter, which is designed as a MEMS loudspeaker. It is not necessarily the case that the tweeter must generate the high frequency sound waves, for example, from above the ear, in order to give the human ear the impression that the sound event has taken place above the ear or the head of the wearer. With the aid of the tweeter, an acoustic wave field can also be formed, wherein the acoustic wave field can be situated essentially overall at the loudspeaker assembly, so that the human ear is given the impression that the sound event has taken place above the ear. Additionally or alternatively, the acoustic wave field can also be formed by the low frequency sound waves of the woofer. Moreover, the acoustic wave field can also be formed by an interference of the low frequency sound waves and of the high frequency sound waves.

Moreover, the at least one tweeter designed as a MEMS loudspeaker can be arranged radially spaced apart from the woofer, in particular with respect to its low frequency sound beam axis. As a result, the tweeter can be utilized for simulating a sound coming from a certain direction. Moreover, an acoustic wave field can be formed in a large spatial volume.

In one advantageous enhanced embodiment, the at least one tweeter can be arranged relative to the woofer in such a way that its high frequency sound beam axis intersects the low frequency sound beam axis, in a side view. The high frequency sound beam axis and the low frequency sound beam axis can therefore have a common angle of crossing. Due to the fact that the high frequency sound beam axis and the low frequency sound beam axis intersect, in a side view, they can also be skewed in relation to one another, in order to likewise have the angle of crossing. When the two axes are skewed in relation to one another, the two axes can be projected into a plane. Thereupon, the two axes intersect and the angle of crossing can be formed.

As described above, the woofer emits the low frequency sound waves along the low frequency sound beam axis toward the ear. Since the low frequency sound waves have a relatively low frequency, they have a relatively high wavelength. The wavelength is in the range of a few tens of centimeters up to meters. At these wavelengths, the human ear can only poorly localize the point of origin of the sound waves. This means, the low frequency sound waves are essentially unsuitable for the localization of the sound event.

By comparison, a point of origin of sound waves having high frequencies can be well located by the human ear. The high frequency sound waves, which enable the spatial localization of the sound event by the human ear, can be generated with the aid of the tweeter, which is arranged in such a way that its high frequency sound beam axis intersects the low frequency sound beam axis, in a side view, so that these have the common angle of crossing. Due to the angle of crossing, for example, the high frequency sound waves extending along the high frequency sound beam axis can be generated above the woofer and then extend obliquely from above toward the ear. A listener then gets the impression that the sound event has taken place at a certain height above his/her head.

In a further advantageous enhanced embodiment of the invention, the low frequency sound beam axis is arranged coaxially with an axial direction of the woofer.

It is also advantageous when the low frequency sound beam axis and the high frequency sound beam axis of the at least one tweeter are oriented in parallel to one another. As a result, the low frequency sound waves and the high frequency sound waves can be emitted toward the ear. Reflectances, refractions, and/or defractions of the sound waves can be reduced as a result.

Moreover, it is advantageous when the at least one tweeter is slanted toward the woofer. For example, the high frequency sound beam axis can be arranged coaxially with an axial direction of the tweeter. When the high frequency sound beam axis extends coaxially with the axial direction of the tweeter, the angle of crossing can be formed by the slant of the tweeter with respect to the woofer.

It is advantageous when the housing is open on a front face. As a result, for example, the woofer and/or the at least one tweeter can be introduced into the housing for assembly.

Additionally or alternatively, it is advantageous when a cover element is arranged in the housing and forms a cavity together with the housing. The cover element can be arranged, for example, at the open front face, so that the open front face is closeable with the aid of the cover element. Preferably, the woofer can be arranged in the cavity. The cavity can act, for example, as a resonant cavity for the woofer, so that the low frequency sound waves are amplifiable with the aid of the cavity. The cavity can also be a back volume of the woofer.

It is also advantageous when the cover element comprises a window section, through which the low frequency sound waves of the woofer can exit the cavity. The window section can be designed, for example, in the shape of a grid. With the aid of the window section, the low frequency sound waves can exit the cavity. The cavity remains delimited to a certain extent. The low frequency sound beam axis can advantageously extend through the window section. The window section can also be curved. The window section can curve away from the cavity. As a result, for example, the high frequency sound waves can be reflected at the window section, so that they are redirected to the ear. The high frequency sound beam axis of the tweeter can be directed, for example, toward the window section for this purpose.

Furthermore, it is advantageous when the cover element comprises at least one outlet passage, through which the high frequency sound waves of the at least one tweeter can exit. When the loudspeaker assembly comprises multiple tweeters, multiple outlet passages can also be arranged in the cover element, so that one outlet passage can be assigned to each tweeter. The high frequency sound beam axis of the at least one tweeter can extend through the outlet passage.

Additionally or alternatively, the at least one tweeter can also be arranged in the cavity. As a result, for example, the cavity can also act as a resonant cavity for the tweeter.

Moreover, it is advantageous when the loudspeaker assembly comprises multiple tweeters. Preferably, these are arranged, with respect to the low frequency sound beam axis, circumferentially around the woofer, which is arranged, in particular, in the center.

It is also advantageous when the tweeters are circumferentially spaced apart from one another by, in particular identical or differently-sized, circumferential angles. The tweeters can be arranged around the low frequency sound beam axis. As a result, multiple high frequency sound beam axes of the particular tweeters can be directed from multiple directions toward the ear of the wearer. As a result, a 3D tone can be generated, which can originate from multiple directions.

It is advantageous when the loudspeaker assembly comprises a control unit. The control unit is preferably designed in such a way that at least the tweeters can be operated in a normal mode and/or in a stereoscopic sound mode. In the normal mode, spatial localization of a sound event by the user is not possible. Accordingly, the normal mode is suitable for usual applications, such as listening to music. The stereoscopic sound mode can be utilized, in particular, in the case of image-based applications, such as computer games, motion pictures, or concert recordings. The stereoscopic sound mode makes it possible for the user to perceive sound events based on direction and/or space, i.e., in particular, a 3D stereoscopic sound.

It is advantageous when the control unit is designed in such a way that it actuates all tweeters simultaneously in the normal mode. As a result, a voluminous sound experience coming from all directions can be generated.

It is advantageous when only one of the tweeters and/or only a portion of the tweeters can be actuated simultaneously in the stereoscopic sound mode with the aid of the control unit, so that a sound event can be generated, which can be spatially localized by the user. Advantageously, at least the tweeter located in an angular interval corresponding, in the circumferential direction, to the direction of sound is actuated by the control unit for this purpose. Additionally or alternatively, it is advantageous when multiple or all tweeters can be actuated by the control unit in the stereoscopic sound mode in such a way that the sound waves from various tweeters interfere with one another, so that they cancel each other out and/or amplify one another.

It is also advantageous when the loudspeaker assembly comprises an inertial measurement unit, in particular a gyroscope and/or an acceleration sensor, coupled to the control unit. This is preferably designed in such a way that, with the aid thereof, a spatial orientation and/or a spatial position of the loudspeaker assembly can be detected. Advantageously, the control unit is designed in such a way that, with the aid thereof, the sound event, which can be spatially localized by the user, can be adapted depending on the measured values gathered by the inertial measurement unit.

Additionally or alternatively, the at least one portion of the tweeters can be arranged radially adjacent to the window section. As a result, a compact design of the loudspeaker assembly is possible.

Advantageously, the angle of crossing can be between 90° and 170°. The angle of crossing can also be between 100° and 150°, however. As a result, essentially every point of origin of the sound event in space can be generated. The low frequency sound beam axis, for example, can act as a reference line. Moreover, when, for example, the loudspeaker assembly is arranged in a headphone and is worn by a person, the low frequency sound beam axis can be oriented perpendicularly to the ear. Moreover, when the headphone is worn as intended, the low frequency sound beam axis can be horizontally oriented. When, for example, the angle of crossing is 90°, the high frequency sound beam axis extends perpendicularly to the low frequency sound beam axis. The low frequency sound waves can then originate from a sound event, which has taken place above the head of the wearer or, in the case of virtual reality, is to correspond to a sound event, which has taken place above the head.

The angle of crossing can also be 170°, however, wherein this corresponds to a sound event that has taken place at a greater distance (several meters) next to the ear of the wearer. The high frequency sound beam axis then intersects the low frequency sound beam axis at an acute angle. At such an angle of crossing, the high frequency sound waves impact the ear approximately perpendicularly.

It is also advantageous when the circumferential angle is between 15° and 90°. In this case, the circumferential angle between two tweeters in each case does not need to be the same. For example, two adjacent tweeters can be separated by a circumferential angle of 30°. Another pair of tweeters can be separated by a circumferential angle of 45°. Yet another pair of tweeters can be separated by a circumferential angle of 90°. The smaller the circumferential angle is between any two tweeters, the higher a directional resolution can be of the sound event. This means, the sound event can be more precisely localized in space.

It is also advantageous when the woofer is an electrodynamic loudspeaker. As a result, the low frequency sound waves can be generated in a simple way. When, in addition, the electrodynamic loudspeaker must play back only low tones, it can be optimized with respect to the appropriate frequency spectrum.

Moreover, the invention relates to a headphone to be arranged on and/or over the ear, comprising at least one loudspeaker assembly. With the aid of the headphone, preferably a 3D tone can be generated, so that the human ear can localize an origin of the virtual sound event. The headphone can be utilized, for example, for a virtual reality or an augmented reality.

In this case, the headphone can comprise two loudspeaker assemblies, wherein one loudspeaker assembly is assigned to the left ear and the other loudspeaker assembly is assigned to the right ear. The loudspeaker assembly can be arranged, for example, in an ear cup, which is arranged over and/or on the ear when the headphone is worn. The loudspeaker assembly can therefore be located at a close distance (a few centimeters) next to the ear.

According to the invention, the loudspeaker assembly is designed according to at least one feature described in the preceding description and/or the following description.

In an advantageous enhanced embodiment of the invention, the headphone comprises a control unit, which can actuate a woofer of the loudspeaker assembly in such a way that a sound event reproduced by the headphone can be spatially localized. Additionally or alternatively, the control unit can also actuate a tweeter in such a way that the sound event reproduced by the loudspeaker assembly can be spatially localized.

With the aid of the headphone, for example, tones associated with the virtual reality can be generated, which convey a spatial impression. The headphone can therefore be, for example, part of a device for a virtual reality. With the aid of the virtual reality, for example, it is possible to participate in a virtual orchestral concert. With the aid of the headphone, the associated music can be spatially localized. The music is no longer simply played back. Instead, a wearer of the headphone can be given the impression that the music reaches him/her from a certain position in space.

The control unit can actuate the woofer and/or the tweeter in such a way that the sound event can be spatially localized. In the process, the control unit can time-delay, for example, a signal to the tweeter with respect to the signal of the woofer, so that a spatial impression of the sound arises. The loudspeaker assembly can also comprise multiple tweeters. In this case, the control unit can also actuate the tweeters in various ways, so that the spatial impression arises. For example, the control unit can also delay the reproduction of the sound of a woofer in a loudspeaker assembly with respect to the other woofer in the other loudspeaker assemblies, so that, for example, the ear can determine whether the sound event has taken place to the left or to the right of him/her.

Moreover, the control unit can carry out a wave field synthesis with the aid of the at least one tweeter and/or the woofer. With the aid of the tweeter, the control unit can form an acoustic wave field, which approximates or is even identical to that of a real sound event. As a result, a realistic and spatial sound event can be reproduced. Furthermore, high frequency sound waves that interfere with one another can be generated, for example, with the aid of multiple tweeters. The particular high frequency sound waves cancel each other out and/or amplify one another, so that a nearly realistic acoustic wave field is formed. The wearer of the headphone gets the impression that the sound event has taken place at a certain point in space.

Furthermore, it is advantageous when the headphone comprises an inertial measurement unit, with the aid of which a spatial orientation of the headphone can be determined. Additionally or alternatively, a spatial position of the headphone can also be determined. The inertial measurement unit can comprise, for example, a gyroscope and/or an acceleration sensor. The inertial measurement unit can also be coupled to the control unit for transmitting measurements. The orientation and/or position of the headphone can be determined with the aid of the control unit.

For example, turning motions of the headphone can be determined with the aid of the gyroscope. For example, if the wearer of the headphone turns his/her head to the left and, therefore, the headphone as well, the control unit can determine the new orientation of the head. Thereupon, the control unit can actuate the woofer and/or the at least one tweeter in such a way that the impression is given that the sound event is fixedly arranged in space and does not turn therewith. During the turning of the head, the sound event can travel, for example, from in front of the head to behind the head, so that the wearer gets the impression that the sound event was in front of him/her at the beginning, was next to him/her during the turning of the head, and, finally is behind him/her.

The position in space can also be detected with the aid of the acceleration sensor. If the wearer, for example, runs past a virtual sound event, the source of the sound event initially approaches the wearer and, thereafter, moves away. Thereupon, the control unit can reduce the sound level of the reproduced sound event, for example, according to the increasing distance. The control unit can also change the position of the sound event.

BRIEF DESCRIPTION OF THE DRAWINGS

Further advantages of the invention are described in the following exemplary embodiments. Wherein.

DETAILED DESCRIPTION OF EXEMPLARY EMBODIMENTS

Figure 1:
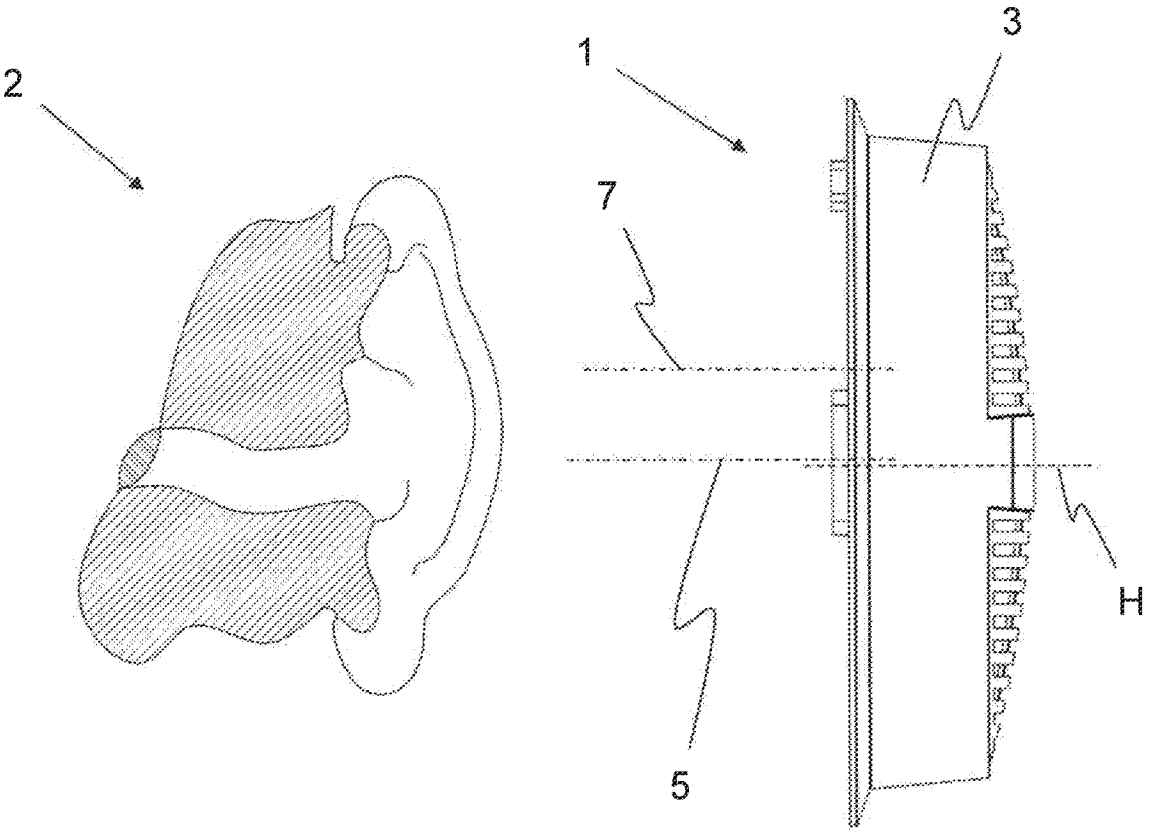
FIG. 1 shows a lateral view of a sectional view of an ear of a wearer and a lateral view of a loudspeaker assembly.

FIG. 1 shows a lateral sectional view of an ear 2 of a wearer and a lateral view of a loudspeaker assembly 1 of the type arranged, for example, in a headphone (not shown here). The loudspeaker assembly 1 can be arranged, for example, in an ear cup of the headphone. The ear cup can enclose, for example, the ear 2, so that ambient noise can be muffled.

As shown in FIG. 1, the loudspeaker assembly 1 can have a distance to the ear 2, which can amount to a few centimeters when the headphone is used as intended. Furthermore, the loudspeaker assembly 1 can face the ear 2. A woofer 4 (not shown here) can be arranged in the loudspeaker assembly 1. A low frequency sound beam axis 5 of the woofer 4 can be directed toward the ear 2. When the headphone is used as intended, it is advantageous that the low frequency sound beam axis 5 faces the ear 2, so that low frequency sound waves, which propagate along the low frequency sound beam axis 5, enter the ear 2. Reflectances, defractions, or refractions of the low frequency sound waves can be reduced as a result. In addition, as a result, the output of the woofer 4 can be kept low. As schematically shown in FIGS. 3-6, the low frequency sound beam axis 5 desirably extends from the center of the woofer 4 in a direction that is normal to the plane in which the woofer 4 extends.

The low frequency sound waves have relatively low frequencies. They can have, for example, frequencies in the range from 20 Hz to 1 kHz-2 kHz. Due to the long wavelength associated with the low frequency, a wearer cannot localize or can only poorly localize a point of origin of the low frequency sound waves.

In order to be able to localize a point of origin of a (virtual) sound event, for example, of an instrument in an orchestra, the loudspeaker assembly 1 comprises at least one tweeter 6 (not shown in FIG. 1). With the aid of the tweeter 6, high frequency sound waves having a frequency of, for example, 1 kHz-2 kHz to 20 kHz-30 kHz can be generated. In this frequency range, a wearer of the headphone can localize the point of origin of the sound event.

Since a human ear 2 is shown in FIG. 1, the orientation designations top, bottom, right, left, front, and back are to be used, for the sake of simplicity, for the description of the figures, when doing so is useful for the explanation of the invention. The ear 2 can be arranged in space, in this case, in the way it is arranged with respect to a person, the wearer, who is standing or is sitting upright. Furthermore, FIG. 1 shows a horizontal H, which can be utilized as a reference plane. When the headphone is used as intended, and when the wearer is standing or is sitting upright, the horizontal H can be parallel to a horizontal of the surroundings. Such references to the surroundings are intended merely to simplify the explanation of the invention.

The tweeter 6 can emit high frequency sound waves along a high frequency sound beam axis 7. As schematically shown in FIGS. 3-6, the high frequency sound beam axis 7 desirably extends from the center of the tweeter 6 in a direction that is normal to the plane in which the tweeter 6 extends. According to the exemplary embodiment shown in FIG. 1, the woofer 4 is arranged so that the low frequency sound beam axis 5 points directly into the ear canal, and the tweeter 6 is arranged above the ear 2 so that the high frequency sound beam axis 7 is parallel to and vertically above the low frequency sound beam axis 5. The wearer can therefore be given the impression that the sound event was above him/her. Additionally or alternatively, at least one further tweeter 6 can also be arranged below the ear 2. As a result, sound events that have taken place below the ear 2 of the wearer can be localized. Moreover, even more tweeters 6 can be arranged in the loudspeaker assembly 1, of course, in order to depict sound events that have taken place in front of and/or behind the wearer.

Figure 2:
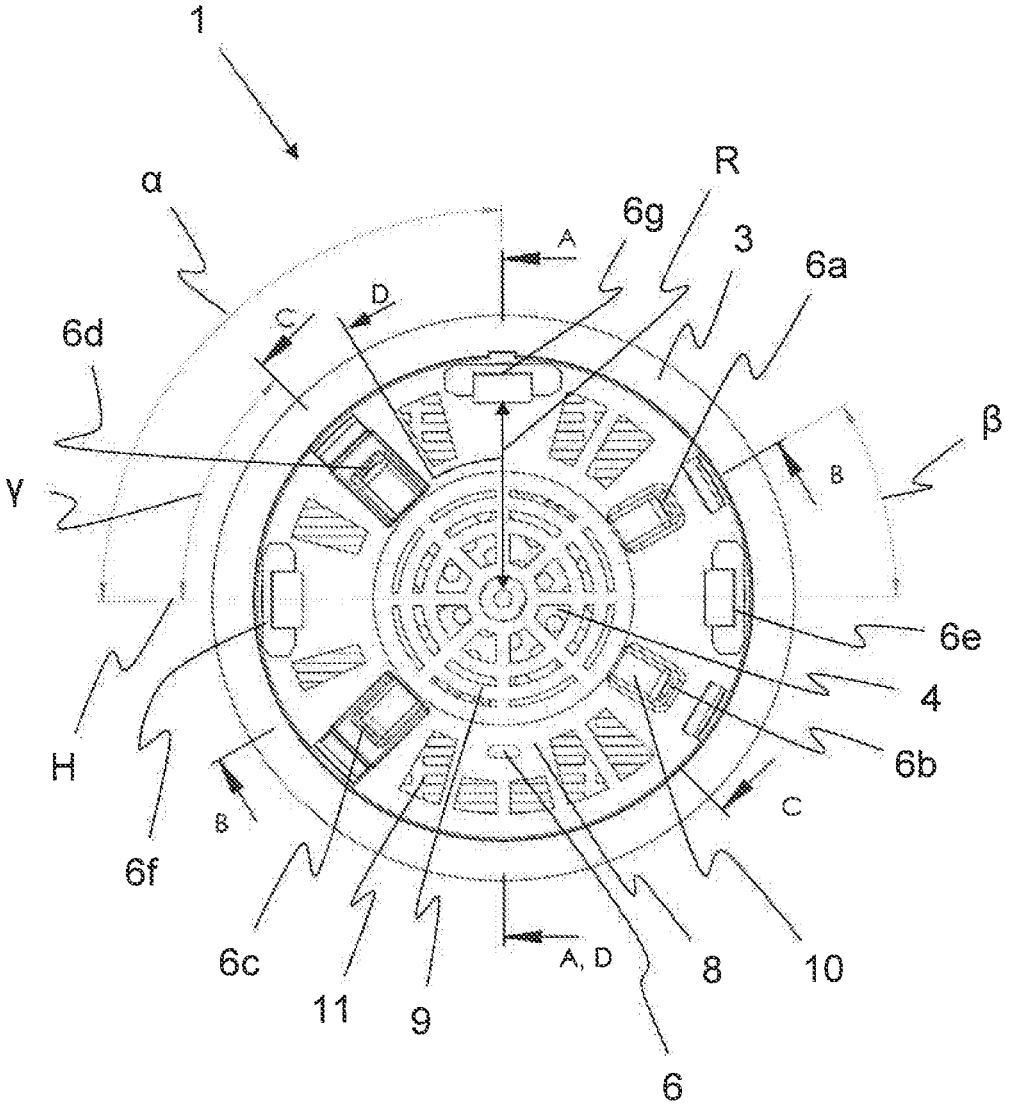
FIG. 2 shows a top view of a loudspeaker assembly comprising a woofer and at least one tweeter.

As schematically shown in FIG. 2, the tweeter 6 is radially spaced apart from the woofer 4. Furthermore, as schematically shown in FIG. 1, the high frequency sound beam axis 7 can be oriented in parallel to the low frequency sound beam axis 5.

FIG. 2 shows a top view of a loudspeaker assembly 1 comprising a woofer 4 and at least one tweeter 6. In the present exemplary embodiment from FIG. 2, the loudspeaker assembly 1 comprises seven tweeters 6*a* through 6*g*.

The woofer 4 is situated centrally in the loudspeaker assembly 1. The low frequency sound beam axis 5 is not shown in FIG. 2. It is directed out of and normal to the plane of the drawing. Additionally or alternatively, the high frequency sound beam axes 7 (not shown here) of the particular tweeters 6*a* through 6*g* can also be directed out of and normal to the plane of the drawing.

Furthermore, as schematically shown in FIGS. 2-7, a cover element 8 is arranged in a housing 3. The cover element 8 comprises a window section 9, through which the low frequency sound waves of the woofer 4 can exit the housing 3. The woofer 4 can be arranged coaxially with the window section 9. In particular, the low frequency sound beam axis 5 can also be arranged coaxially with the window section 9.

The high frequency sound beam axes 7 of the particular tweeters 6*a* through 6*g* can be arranged perpendicularly to the cover element 8. Additionally or alternatively, the low frequency sound beam axis 5 can also be arranged perpendicularly to the cover element 8.

Figure 7:
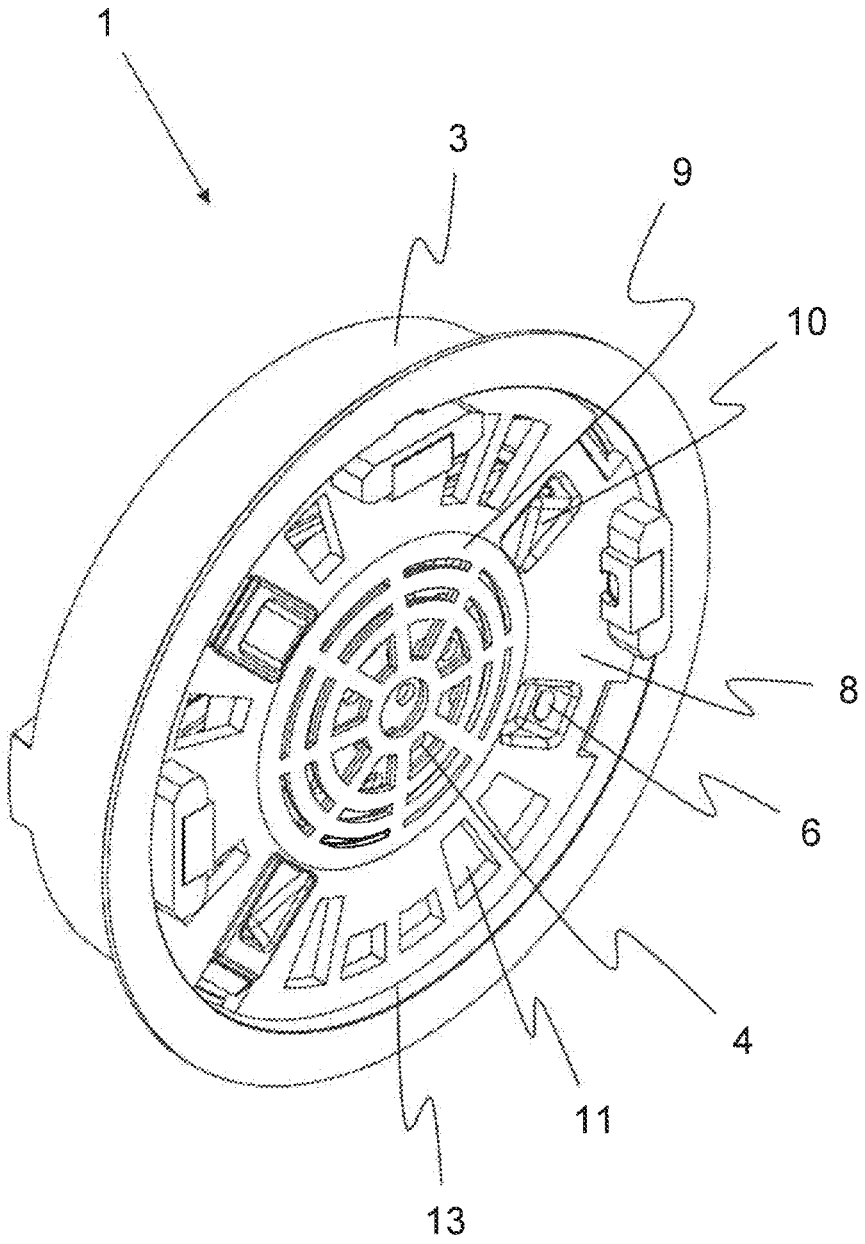
FIG. 7 shows a perspective view of the loudspeaker assembly comprising a woofer and multiple tweeters.

As schematically shown in FIGS. 2 and 7, the cover element 8 also comprises at least one outlet passage 10. In the present exemplary embodiment from FIG. 2, the cover element 8 comprises multiple outlet passages 10, wherein only one outlet passage 10 is provided with a reference character, for the sake of simplicity. According to the present exemplary embodiment, one outlet passage 10 is assigned to each tweeter 6*a* through 6*g*. Through the outlet passage 10, the high frequency sound waves of the tweeters 6*a* through 6*g* can exit through the cover element 8 and out of the housing 3.

Moreover, as schematically shown in FIGS. 2 and 7, the cover element 8 comprises multiple openings 11, wherein only one opening 11 is provided with a reference character, for the sake of simplicity. With the aid of the openings 11, for example, a pressure compensation can take place between a cavity 12 in the housing 3 and the surroundings.

The tweeters 6*a* through 6*g* are arranged spaced apart from one another circumferentially around the woofer 4. As schematically shown in FIG. 2, the tweeters 6*a* through 6*g* are spaced apart from one another by a circumferential angle $\alpha$, $\beta$, $\gamma$. As schematically shown according to FIGS. 1 and 2, a reference plane H is defined and disposed with respect to the orientation of the loudspeaker assembly 1. The horizontal plane H can be arranged, for example, in the headphone in such a way that, when the headphone is used as intended, the horizontal plane H is also oriented horizontally with respect to the surroundings. The tweeter 6*g* can therefore be arranged, for example, above the ear 2.

For example, the circumferential angle $\alpha$ can be formed between the tweeters 6*g* and 6*f*. Moreover, the circumferential angle $\beta$ can be formed between the tweeters 6*a* and 6*e*. Furthermore, the circumferential angle $\gamma$ can be formed between the tweeters 6*d* and 6*f*. The circumferential angles $\alpha$, $\beta$, $\gamma$ can be in a range between 15° and 90°. The smaller the circumferential angles $\alpha$, $\beta$, $\gamma$ are, the more precisely can the direction of the sound event be localized.

In addition, as schematically shown in FIG. 2, the tweeters 6*a* through 6*g* can have a radial distance R to the woofer 4, in particular to the low frequency sound beam axis 5. For the sake of simplicity, only the tweeter 6*g* is shown with the radial distance R. For example, the tweeters 6*a* through 6*d* have a shorter radial distance R to the woofer 4 than the tweeter 6*g*. According to the present exemplary embodiment, the tweeters 6*a* through 6*d* are arranged adjacent to the window section 9. In particular, the outlet passages 10 of the tweeters 6*a* through 6*d* can adjoin the window section 9.

Figure 8:
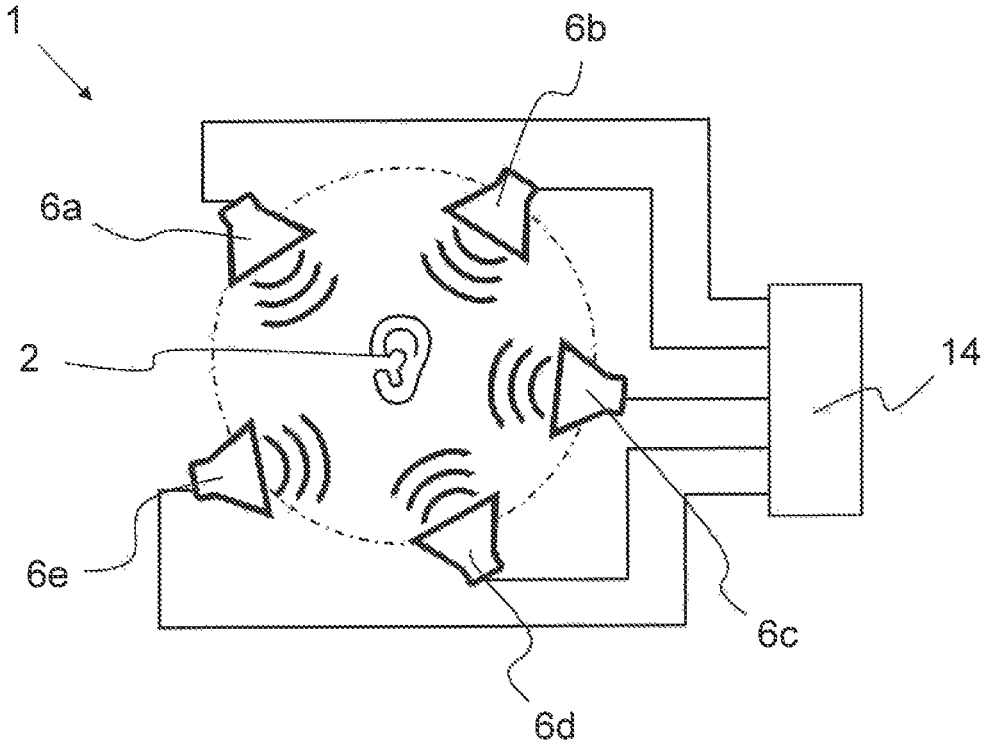
FIG. 8 shows a schematic representation of the loudspeaker assembly in a normal mode.
Figure 9:
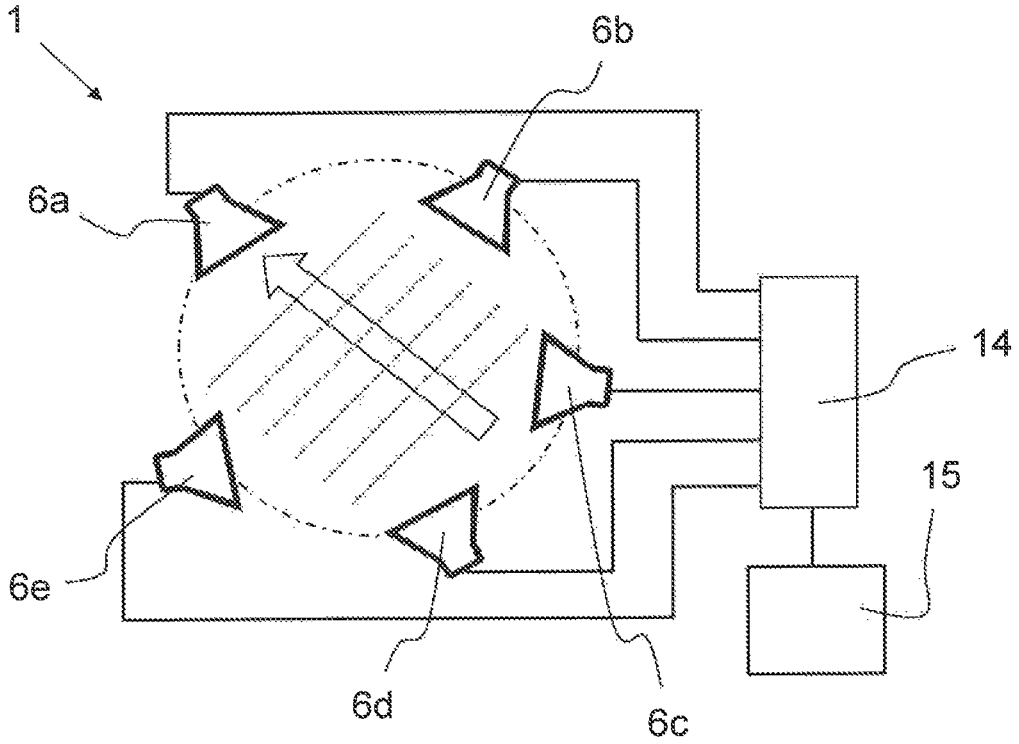
FIG. 9 shows a schematic representation of the loudspeaker assembly in a stereoscopic sound mode.

A control unit 14 shown schematically in FIGS. 8 and 9) can actuate the tweeters 6*a* through 6*g* in various ways in order to generate a 3D tone. In this way, the tweeters 6*a* through 6*g* can be operated by the control unit 14 in a normal mode schematically represented in FIG. 8 and in a stereoscopic sound mode schematically represented in FIG. 9. In the stereoscopic sound mode, the control unit 14 can actuate only one or a few tweeters 6*a* through 6*g*, so that the high frequency sound waves reach the ear 2 from only one direction. As a result, a certain localizability of the sound event is already established. The control unit 14 can also actuate the tweeters 6*a* through 6*g* according to a wave field synthesis, however. Virtual acoustic surroundings can be created with the aid of the wave field synthesis. For this purpose, the control unit 14 can actuate a few tweeters 6*a* through 6*g* in such a way that an acoustic wave field is formed by the tweeters 6*a* through 6*g*, which corresponds to that of a real sound event or at least comes close thereto. In the process, the sound waves from various tweeters 6*a* through 6*g* can interfere with one another, so that they cancel each other out and/or amplify one another. As a result, an acoustic wave field can be generated, which gives the impression that the sound event reaches the ear 2 from a certain direction.

Furthermore, according to the present exemplary embodiment from FIG. 2, the tweeters 6*e* and 6*f* can lie on the horizontal reference plane H. When the headphone comprising the loudspeaker assembly 1 is worn as intended, for example, a sound event that arose in front of and/or behind the ear 2 can be localized with the aid of the two tweeters 6*e*, 6*f*.

With the aid of the tweeter 6*g*, for example, a sound event that took place above the ear 2 can be localized. A sound event that took place, for example, obliquely underneath can be represented with the aid of the tweeter 6*c*. A sound event that took place, for example, obliquely overhead can be represented with the aid of the tweeter 6*d*. A sound event that took place obliquely overhead and/or obliquely underneath can be represented with the aid of the two tweeters 6*a*, 6*b*.

FIGS. 3, 4, 5, 6 each show a sectional view of the loudspeaker assembly 1 according to the lines of planes A-A, B-B, C-C and D-D cut from FIG. 2.

The housing 3 shown in FIGS. 3, 4, 5, 6 is open on a front face 13. The housing 3, which is open on the front face 13, can be closed with the aid of the cover element 8. The housing 3 and the cover element 8 delimit a cavity 12 in the housing 3. The woofer 4 can be arranged in the cavity 12. The cavity 12 can act, for example, as a resonant cavity for the woofer 4. The cavity 12 can also be a back volume of the woofer 4. Additionally or alternatively, the at least one tweeter 6 can also be arranged in the cavity 12.

The cover element 8 comprises the window section 9 in a central region. The window section 9 and the woofer 4 can be arranged coaxially with one another. The window section 9 can also be arranged coaxially with the low frequency sound beam axis 5. The window section 9 can be curved outwardly, away from the cavity 12, in the region of the woofer 4.

According to the woofer 4 shown in FIGS. 3, 4, 5, 6, the woofer 4 can be designed as an electrodynamic loudspeaker.

The tweeters 6, which can be designed as MEMS loudspeakers, are also shown. One advantage of MEMS loudspeakers is that they can be designed to be small. Furthermore, the MEMS loudspeaker has a low total harmonic distortion. Sound waves having low distortion can be reproduced with the aid of the MEMS loudspeaker. Furthermore, a broad frequency spectrum can be covered with the aid of the MEMS loudspeaker.

Figure 3:
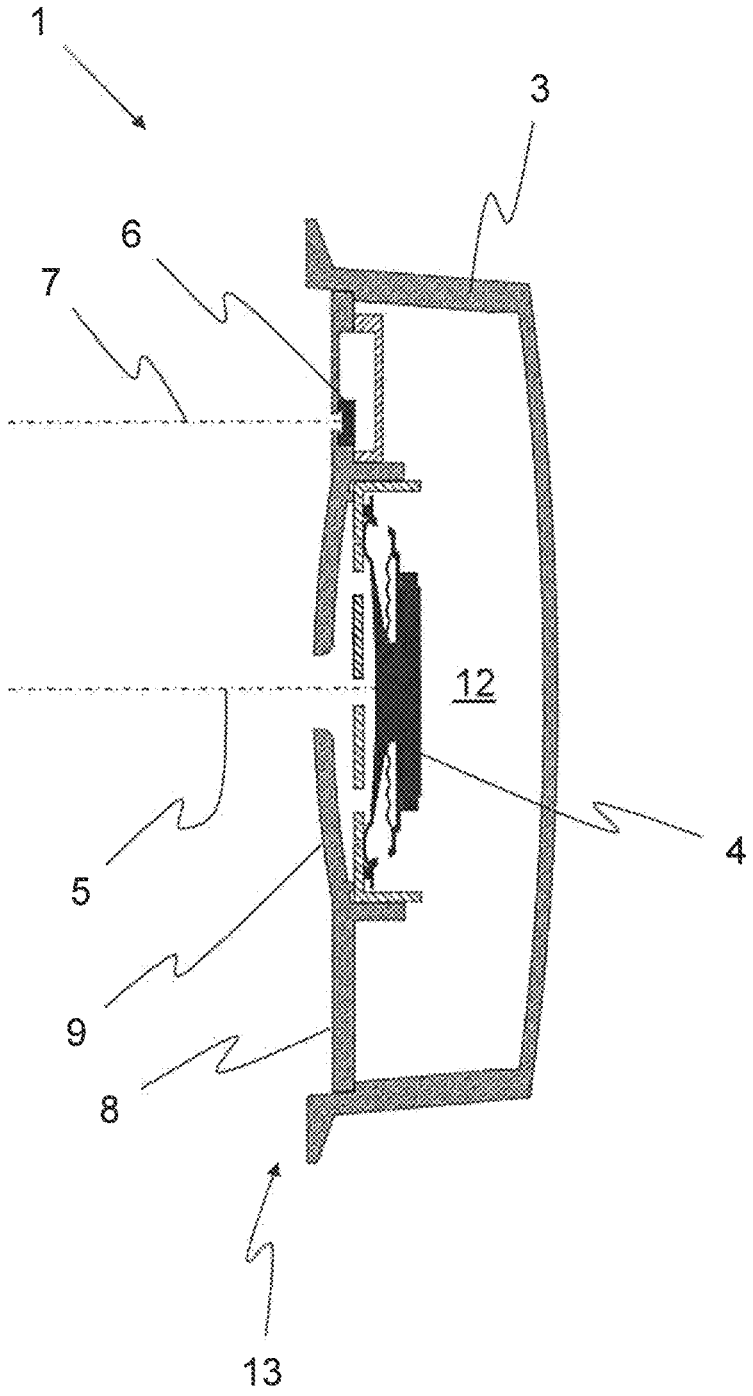
FIG. 3 shows a sectional view of a loudspeaker assembly according to a section line D-D from FIG. 2.

FIG. 3 shows the section along the line of cut D-D from FIG. 2. According to FIG. 3 and FIG. 2, the tweeter 6 is arranged in such a way that its high frequency sound beam axis 7 is oriented in parallel to the low frequency sound beam axis 5 of the woofer 4. As a result, the high frequency sound waves can be emitted along the high frequency sound beam axis 7 toward the ear 2. The human ear gets the impression that a sound event has taken place above the ear 2.

Figure 4:
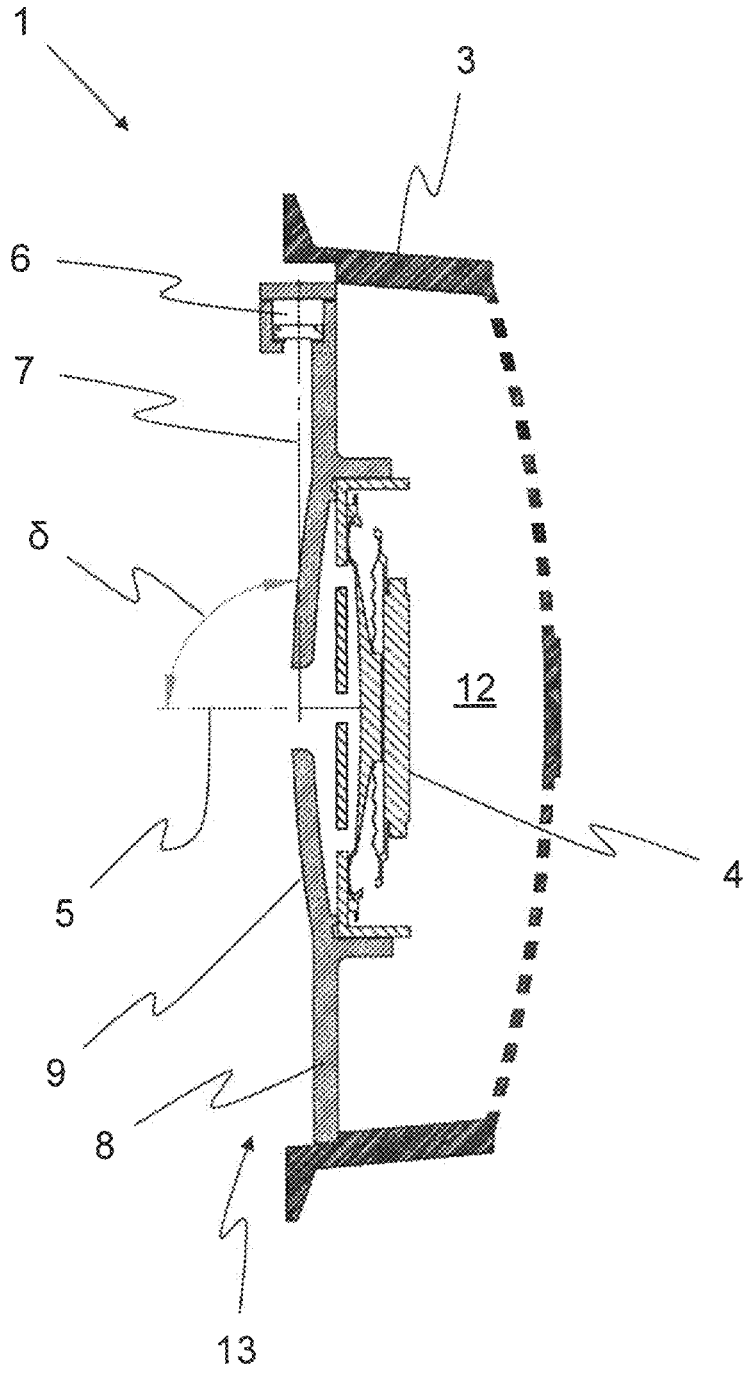
FIG. 4 shows a sectional view according to a section line A-A from FIG. 2.
Figure 5:
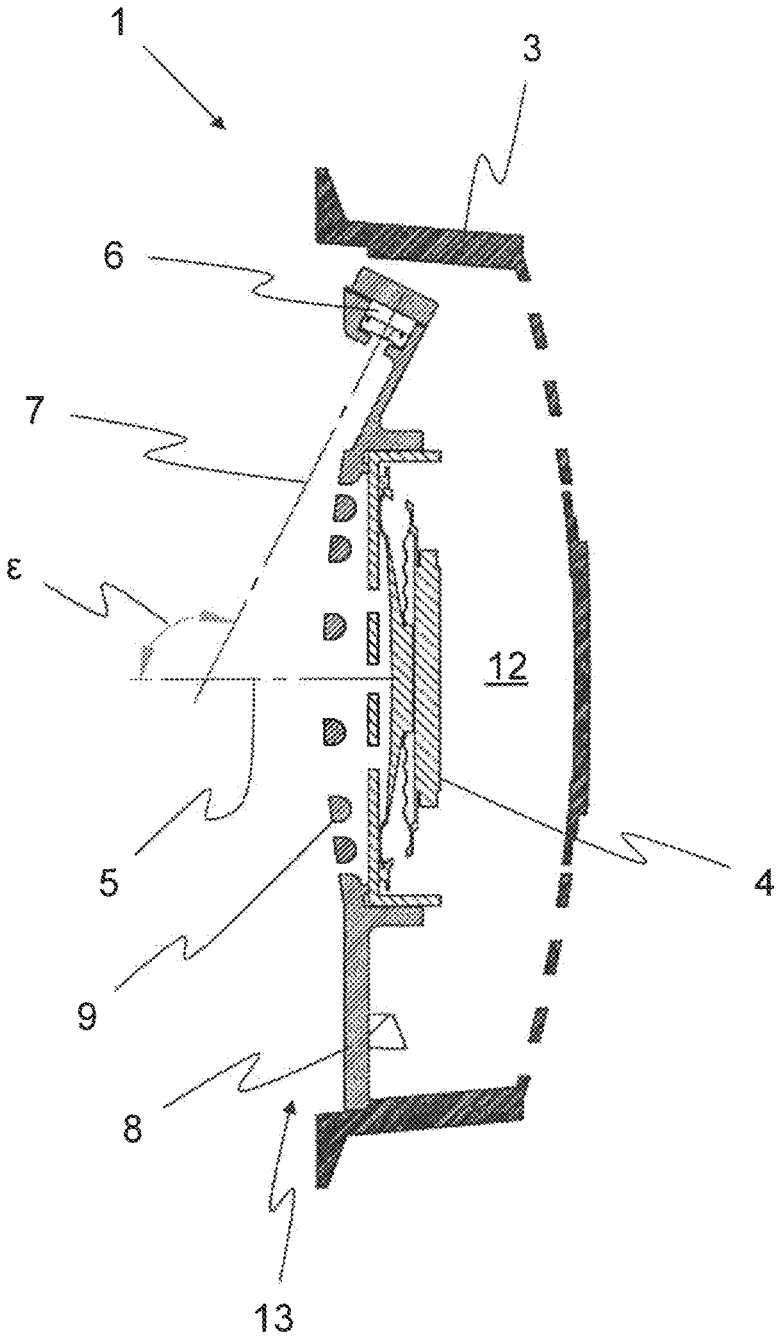
FIG. 5 shows a sectional view according to a section line B-B from FIG. 2.
Figure 6:
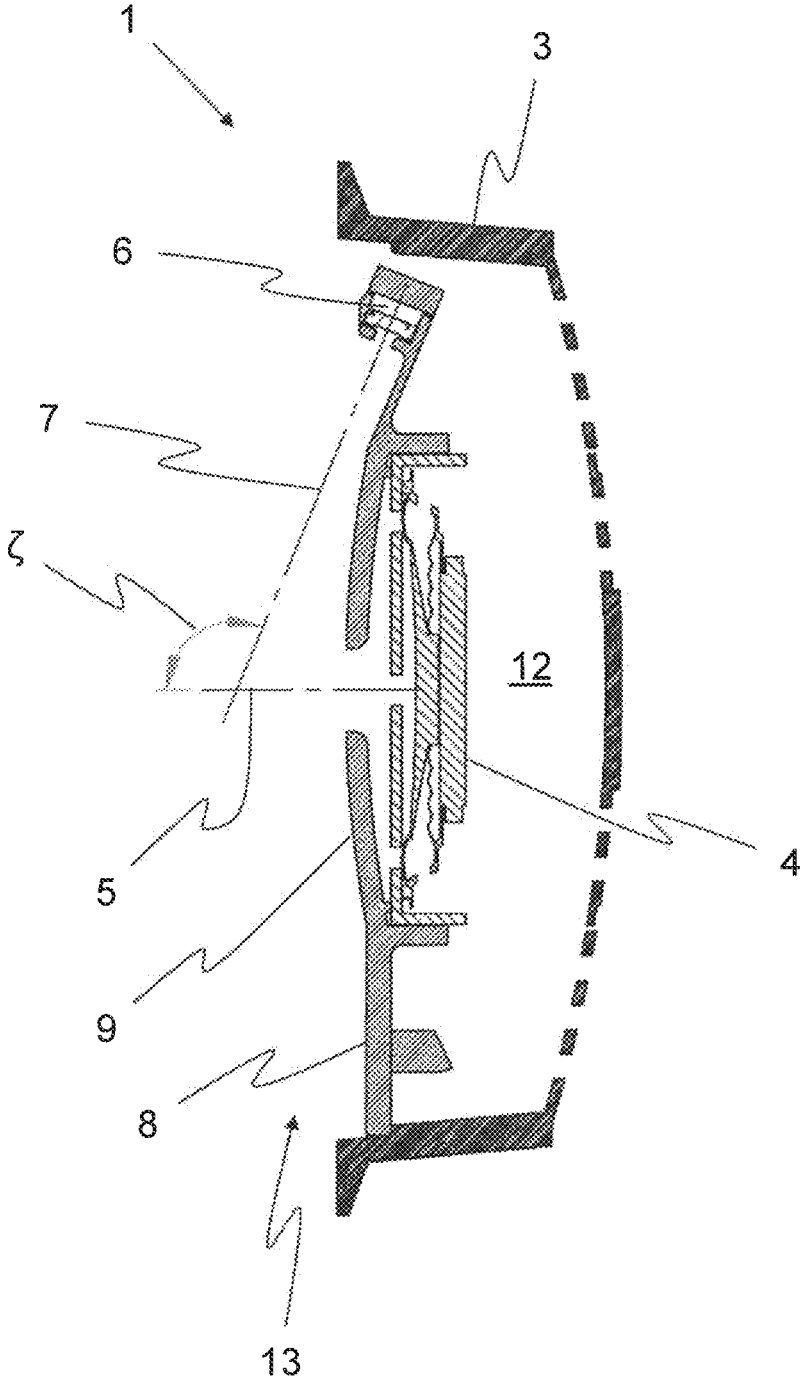
FIG. 6 shows a sectional view according to a section line C-C from FIG. 2.

According to the FIGS. 4, 5, 6, the at least one tweeter 6 is arranged in relation to the woofer 4 in such a way that its high frequency sound beam axis 7 intersects the low frequency sound beam axis 5 in the sectional view shown here. The high frequency sound beam axis 7 has an angle of crossing δ, ε, ζ with respect to the low frequency sound beam axis 5.

FIG. 4 shows the section along the line of cut A-A from FIG. 2. According to FIG. 4, the angle of crossing δ can be 90°. The high frequency sound beam axis 7 is therefore perpendicular to the low frequency sound beam axis 5. The high frequency sound waves of the tweeter 6 can also interfere with other high frequency sound waves, however, in order to form an acoustic wave field. A sound event that originates from above the ear 2 can be generated with the aid of the tweeter 6.

FIG. 5 shows the section along the line of cut B-B from FIG. 2. According to FIG. 5, the angle of crossing ε can be 110°. The high frequency sound waves can then be emitted along the high frequency sound beam axis 7 in the direction of the ear 2.

FIG. 6 shows the section along the line of cut C-C from FIG. 2. According to FIG. 6, the angle of crossing ζ can also be in the range of 120°. The high frequency sound waves can then be emitted along the high frequency sound beam axis 7 in the direction of the ear 2.

An intersection point of the high frequency sound beam axes 7 with the low frequency sound beam axis 5 shown according to FIGS. 4, 5, 6 does not need to be arranged in front of the ear 2. The intersection point can also be arranged behind the ear 2, i.e., within the head.

FIG. 7 shows a perspective view of the loudspeaker assembly 1. The features are known from the preceding figures, so that an explanation of FIG. 7 will be dispensed with.

A loudspeaker assembly 1 comprising the above-described control unit 14 is schematically represented in FIGS. 8 and 9. The loudspeaker assembly 1 can be designed according to one or more of the aforementioned exemplary embodiments, wherein the aforementioned features can be present individually or in any combination. In particular, the loudspeaker assembly can comprise multiple tweeters **6*a* through 6*g* designed as MEMS loudspeakers. These can all—or individually—have the angles of crossing δ, ε, ζ described in FIGS. 4 through 6**.

In all aforementioned exemplary embodiments, the control unit 14 is designed in such a way that it can operate the tweeters **6*a* through 6*g* in a normal mode (cf. FIG. 8) and/or in a stereoscopic sound mode (cf. FIG. 9**). In the normal mode, spatial localization of a sound event by the user is not possible. Accordingly, the normal mode is suitable for usual applications, such as listening to music. The stereoscopic sound mode can be utilized, in particular, in the case of image-based applications, such as computer games, motion pictures, or concert recordings. The stereoscopic sound mode makes it possible for the user to perceive sound events based on direction and/or space, i.e., in particular, a 3D stereoscopic sound.

For this purpose, the control unit 14 is designed in such a way that it simultaneously actuates all tweeters **6*a* through 6*g*** in the normal mode. Therefore, a voluminous sound experience coming from all directions can be generated.

In the stereoscopic sound mode represented in FIG. 9, only one of the tweeters **6*a* through 6*g* and/or only a portion of the tweeters 6*a* through 6*g* can be actuated simultaneously by the control unit 14, so that a sound event can be generated, which can be spatially localized by the user and is indicated in FIG. 9 with the aid of the arrow. Advantageously, for this purpose, at least the tweeter 6*a* through 6*g* located in an angular interval corresponding, in the circumferential direction, to the direction of sound, i.e., according to the figure, the two tweeters 6*a* through 6*g* located in the lower right, is actuated by the control unit 14. Additionally or alternatively, it is advantageous when multiple or all tweeters can be actuated by the control unit 14 in the stereoscopic sound mode in such a way that the sound waves from various tweeters 6*a* through 6*g*** interfere with one another, so that they cancel each other out and/or amplify one another, in order to generate the stereoscopic sound experience.

In an exemplary embodiment schematically represented in FIG. 9, the loudspeaker assembly 1 comprises an inertial measurement unit 15, in particular a gyroscope and/or an acceleration sensor, coupled to the control unit 14. This is preferably designed in such a way that, with the aid thereof, a spatial orientation and/or a spatial position of the loudspeaker assembly 1 can be detected. Advantageously, the control unit 14 is designed in such a way that, with the aid thereof, the sound event, which can be spatially localized by the user, can be adapted depending on the measured values gathered by the inertial measurement unit 15.

Figure 10:
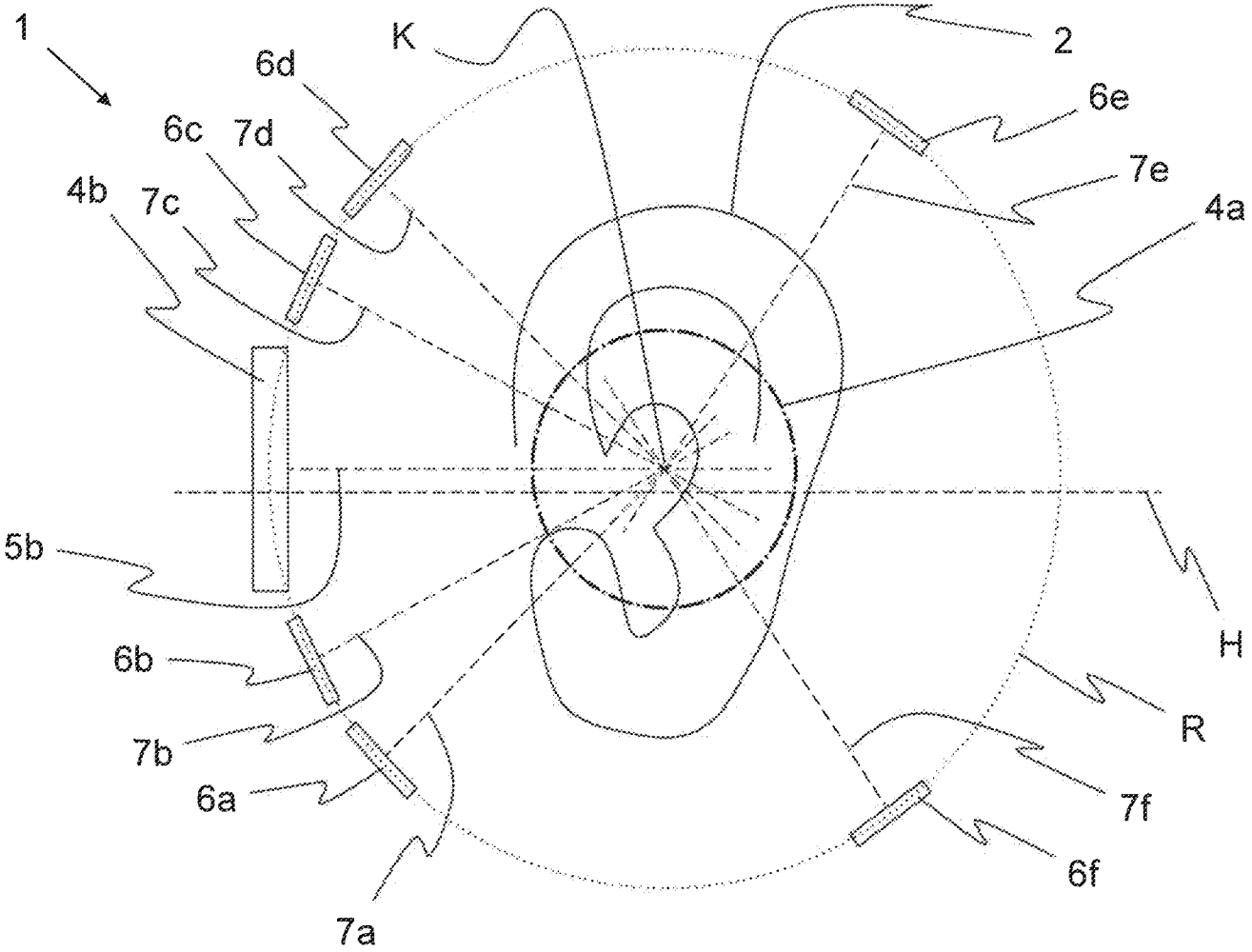
FIG. 10 shows a schematic representation of a positioning of the loudspeaker assembly with respect to the ear.

FIG. 10 shows a schematic representation of a positioning of the loudspeaker assembly 1 with respect to the ear 2. According to the present exemplary embodiment, the ear 2 is shown from the outside, wherein the loudspeaker assembly 1 is arranged over the ear 2. FIG. 10 therefore shows an example of a positioning of the loudspeaker assembly 1 with respect to the ear 2 of a listener during use as intended. The viewing direction is from the outside onto the loudspeaker assembly 1 and onto the ear 2. The horizontal reference plane H is also shown in FIG. 10.

According to the present exemplary embodiment, the loudspeaker assembly 1 comprises multiple woofers **4*a*, 4*b*. The first woofer 4*a* is represented in FIG. 10 as a circle formed by a dotted line and is arranged over the ear 2 when the loudspeaker assembly 1 is positioned as intended. When the loudspeaker assembly 1 is used as intended, the woofer 4***a* is arranged coaxially with the ear 2 or an ear canal of the ear 2. As a result, the low frequency sound beam axis is oriented coaxially with the ear 2 and with the ear canal. The low frequency sound beam axis is not shown here. It is perpendicular to FIG. 10. It extends into the plane of the drawing. The low frequency sound waves generated by the woofer 4*a* therefore enter, in particular directly, the ear canal and, therefore, reach the tympanic membrane.

According to the present exemplary embodiment, the loudspeaker assembly 1 comprises a second woofer 4*b*. This woofer 4*b* is arranged in front of the ear 2 when the loudspeaker assembly 1 is positioned or arranged as intended. In this case, "front" means the directions "front" and "back", which are usual for a person. The low frequency sound beam axis 5*b* is arranged in parallel to the horizontal reference plane H. Additionally or alternatively, the low frequency sound beam axis of the first woofer 4*a* and the low frequency sound beam axis 5*b* of the second woofer 4*b* are oriented perpendicularly to one another. The second woofer 4*b* can also be arranged in the loudspeaker assembly 1 in such a way, however, that the low frequency sound beam axis 5*b* of the second woofer 4*b* is slanted toward the ear 2, so that the low frequency sound waves enter the ear 2 obliquely from the front.

Additionally or alternatively, a woofer 4 (not shown here) can also be arranged behind the ear 2. This woofer 4 can be arranged behind the ear 2 as a mirror image of the second woofer 4*b* (shown here) with respect to a center line of the loudspeaker assembly 1. The woofer 4 (not shown here) can be arranged in the loudspeaker assembly 1 in the same manner as the second woofer 4*b*, although not in front of the ear 2 but rather behind the ear 2.

Moreover, the loudspeaker assembly 1 from FIG. 10 comprises a plurality of tweeters 6*a* through 6*f*. According to the present exemplary embodiment, in particular all tweeters 6*a* through 6*f* are spaced apart from the horizontal reference plane H. Moreover, the tweeters 6*a* through 6*f* are arranged at an angle with respect to one another.

Advantageously, at least a portion of the high frequency sound beam axes 7 and/or of the low frequency sound beam axes 5 can intersect at an intersection point K. The intersection point K can also be an intersection line. As a result, at least a portion of the high frequency sound beam axes 7 and/or of the low frequency sound beam axes 5 extend through the intersection line K.

According to the present exemplary embodiment, the high frequency sound beam axes 7*a* through 7*f* of the tweeters 6*a* through 6*f* intersect at the intersection point K. Additionally or alternatively, the low frequency sound beam axis 5*b* of the second woofer 4*b* and/or the low frequency sound beam axis (not shown here) of the first woofer 4*a* can also extend through the intersection point K. As a result, according to the present exemplary embodiment, all sound axes—whether they are low frequency sound beam axes 5 or high frequency sound beam axes 7—intersect at an intersection point K. The sound transducers—whether they are woofers 4 or tweeters 6—can be arranged in the loudspeaker assembly 1 in such a way that the intersection point K is located over the ear 2 when the loudspeaker assembly 1 is positioned as intended. As a result, for example, a stereoscopic sound can be generated, which is not distorted or only slightly distorted.

According to the present exemplary embodiment, the four tweeters 6*a* through 6*d* are arranged in front of the ear 2 and the two tweeters 6*e*, 6*f* are arranged behind the ear 2. It is advantageous when more tweeters 6 are arranged in front of the ear 2 than behind the ear 2. Since most virtual sound events take place in front of the user during normal use of the loudspeaker assembly 1, it is advantageous when more tweeters 6 and/or woofers 4 are arranged in front of the ear 2 (normally, for example, in the case of a virtual reality application, the user looks at the event generating the virtual sound event, so that it is in front of the user).

According to the present exemplary embodiment, the tweeters 6*a* through 6*f* and the second woofer 4*b* are arranged on a circle formed by a dotted line, having the radius R, shown in FIG. 10. This means, the tweeters 6*a* through 6*f* and the second woofer 4*b* all have the same distance to the centrally arranged first woofer 4*a*. Since the first woofer 4*a* is arranged directly over the ear 2, the tweeters 6*a* through 6*f* and the second woofer 4*b* all have the same distance to the ear 2. This distance is precisely the radius R of the circle. The distance is also the radial distance R. As a result, the propagation times of the sound waves of the tweeters 6*a* through 6*f* and of the second woofer 4*b* to the ear 2 are equal to each other. Additionally or alternatively, the first woofer 4*a* can also have the radius R or the radial distance R to the ear 2. As a result, all sound transducers—whether they are woofers 4 or tweeters 6—can have the same distance to the ear 2. All sound transducers, whether they are woofers 4 or tweeters 6, can therefore be arranged in the loudspeaker assembly 1 in a bowl-shaped manner, in particular, a spherical bowl-shaped manner. As a result, in the case of a positioning of the loudspeaker assembly 1 over the ear 2 as intended, all sound transducers have the same distance to the ear 2, so that all sound waves reach the ear 2 at the same time or have the same propagation time to the ear 2 with respect to one another.

The present invention is not limited to the represented and described exemplary embodiments. Modifications within the scope of the claims are also possible, as is any combination of the features, even if they are represented and described in different exemplary embodiments.

LIST OF REFERENCE CHARACTERS

1 loudspeaker assembly
2 ear
3 housing
4 woofer
5 low frequency sound beam axis
6 tweeter
7 high frequency sound beam axis
8 cover element
9 window section
10 outlet passage
11 openings
12 cavity
13 front face
14 control unit
α, β, γ circumferential angle
δ, ε, ζ angle of crossing
H horizontal
R radial distance
K intersection point

The invention claimed is:

1. A loudspeaker assembly for on-ear headphones, to be arranged on and/or over an ear of the user, the loudspeaker assembly comprising:

a housing;

a woofer disposed in the housing and configured to emit low frequency sound waves along a low frequency sound beam axis toward the ear; and a plurality of tweeters disposed in the housing, each of the plurality of tweeters being configured to emit high frequency sound waves along a respective high frequency sound beam axis; and wherein each of the plurality of tweeters is a MEMS loudspeaker and is arranged radially spaced apart from the low frequency sound axis;

wherein each of the plurality of tweeters is arranged circumferentially around the woofer and the low frequency sound beam axis; and wherein the housing is configured so that when the loudspeaker assembly is in use as intended on or over an ear of the user, a first number of the plurality of tweeters is arranged in front of the ear and a second number of the plurality of tweeters is arranged behind the ear such that the first number exceeds the second number.

2. The loudspeaker assembly as claimed in claim 1, wherein a first one of the plurality of tweeters is arranged relative to the woofer in such a way that the high frequency sound beam axis intersects the low frequency sound beam axis, in a side view, so that these have a common angle of crossing.

3. The loudspeaker assembly as claimed in claim 2, wherein the angle of crossing is between 100° and 150°.

4. The loudspeaker assembly as claimed in claim 2, wherein the circumferential angle is between 15° and 90°.

5. The loudspeaker assembly according to claim 1, wherein the low frequency sound beam axis and the high frequency sound beam axis are oriented in parallel to one another.

6. The loudspeaker assembly as claimed in claim 1, wherein the high frequency sound beam axis of a first one of the plurality of tweeters is slanted toward the woofer.

7. The loudspeaker assembly as claimed in claim 1, further comprising a cover element, wherein the housing is open on a front face and the cover element is arranged on the open front face to form a cavity with the housing.

8. The loudspeaker assembly as claimed in claim 7, wherein each of the plurality of tweeters is arranged in the cavity.

9. The loudspeaker assembly as claimed in claim 1, wherein a first one of the plurality of tweeters is circumferentially spaced apart from a second one of the plurality of tweeters by identical circumferential angles.

10. The loudspeaker assembly as claimed in claim 1, further comprising a control unit that is configured to operate each of the plurality of tweeters in a normal mode and/or in a stereoscopic sound mode.

11. The loudspeaker assembly as claimed in claim 10, wherein the control unit is designed in such a way that it actuates a first one of the plurality of tweeters in the stereoscopic sound mode in order to generate a sound event that is spatially localizable for a user.

12. The loudspeaker assembly as claimed in claim 10, further comprising an inertial measurement unit coupled to the control unit wherein the inertial measurement unit is configured to detect a spatial orientation and/or a spatial position of the first one of the plurality of tweeters and gather measured values about the spatial orientation and spatial position of the loudspeaker assembly.

13. The loudspeaker assembly as claimed in claim 12, wherein the control unit is configured to adapt the sound event depending on measured values gathered by the inertial measurement unit.

14. The loudspeaker assembly as claimed in claim 1, wherein the woofer is an electrodynamic loudspeaker.

15. The loudspeaker assembly as claimed in claim 1, further comprising:

a control unit that is configured to operate a first one of the plurality of tweeters in a stereoscopic sound mode and configured to operate a second one of the plurality of tweeters in a stereoscopic sound mode, wherein the control unit is configured to actuate the first tweeter and the second tweeter to generate a sound event that is spatially localizable for a user.

16. The loudspeaker assembly as claimed in claim 1, further comprising:

a control unit that is configured to operate a first one of the plurality of tweeters in a stereoscopic sound mode and configured to operate a second one of the plurality of tweeters in a stereoscopic sound mode, wherein the control unit is configured to actuate the first tweeter and the second tweeter in such a way that the sound waves of the first tweeter interfere with the sound waves of the second tweeter, so that they amplify one another.

17. The loudspeaker assembly as claimed in claim 1, wherein a first one of the plurality of tweeters is circumferentially spaced apart from a second one of the plurality of tweeters by different circumferential angles.

18. Headphones to be arranged on and/or over an ear of the user, the headphones comprising:

a loudspeaker assembly that includes a housing, a woofer disposed in the housing and configured to emit low frequency sound waves along a low frequency sound beam axis toward the ear, and a plurality of tweeters disposed in the housing, each of the plurality of tweeters being configured to emit high frequency sound waves along a respective high frequency sound beam axis, wherein each of the plurality of tweeters is a MEMS loudspeaker and is arranged radially spaced apart from the low frequency sound axis;

wherein each of the plurality of tweeters is arranged circumferentially around the woofer and the low frequency sound beam axis; and wherein the housing is configured so that when the loudspeaker assembly is in use as intended on or over an ear of the user, a first number of the plurality of tweeters is arranged in front of the ear and a second number of the plurality of tweeters is arranged behind the ear such that the first number exceeds the second number.

* * * * *